US009220309B2

(12) United States Patent
Gayer

(10) Patent No.: US 9,220,309 B2
(45) Date of Patent: Dec. 29, 2015

(54) HOMERUN BALL CATCHING CAP SYSTEMS

(71) Applicant: Robert E Gayer, Tempe, AZ (US)

(72) Inventor: Robert E Gayer, Tempe, AZ (US)

( * ) Notice: Subject to any disclaimer, the term of this patent is extended or adjusted under 35 U.S.C. 154(b) by 0 days.

(21) Appl. No.: 14/571,446

(22) Filed: Dec. 16, 2014

(65) Prior Publication Data

US 2015/0164167 A1 Jun. 18, 2015

Related U.S. Application Data

(60) Provisional application No. 61/917,401, filed on Dec. 18, 2013.

(51) Int. Cl.
*A42B 1/06* (2006.01)
*A42B 1/00* (2006.01)

(52) U.S. Cl.
CPC ..... *A42B 1/062* (2013.01); *A42B 1/006* (2013.01)

(58) Field of Classification Search
CPC ..... A42B 1/00; A42B 1/062; A42B 1/063; A42B 3/22
USPC ..... 2/171, 209.5, 209.7, 209.13, 209.12, 2/175.1, 195.1
See application file for complete search history.

(56) References Cited

U.S. PATENT DOCUMENTS

| | | | | |
|---|---|---|---|---|
| 1,782,206 | A * | 11/1930 | Kornsweet | 2/12 |
| 5,920,913 | A * | 7/1999 | Brandon et al. | 2/209.12 |
| 5,987,648 | A * | 11/1999 | Boyd | 2/195.1 |
| 6,158,054 | A * | 12/2000 | Perry, Sr. | 2/195.1 |
| 6,457,183 | B1 * | 10/2002 | Perry, Sr. | 2/209.12 |
| 7,640,607 | B2 * | 1/2010 | Guertin et al. | 5/601 |
| 8,234,721 | B1 * | 8/2012 | Cestare et al. | 2/171.1 |
| D689,266 | S * | 9/2013 | Megela et al. | D2/889 |
| 2007/0271679 | A1 * | 11/2007 | Wysopal | 2/209.13 |
| 2010/0064419 | A1 * | 3/2010 | Lee | 2/209.13 |
| 2011/0041238 | A1 * | 2/2011 | Brzoska | 2/209.13 |
| 2013/0047317 | A1 * | 2/2013 | Hanover et al. | 2/209.12 |
| 2013/0333098 | A1 * | 12/2013 | Nimmons et al. | 2/414 |

* cited by examiner

*Primary Examiner* — Gloria Hale

(57) ABSTRACT

A homerun ball catching cap includes a cap assembly having a concave crown (having a forward edge, a rearward edge, an inner volume, and an outer surface that provides a surface on which to mount a team-logo patch), a headband with an adjustment strap, a bill, and circular finger apertures, wherein the cap assembly comprises in functional combination the concave crown, the headband, the bill, and the circular finger apertures. The homerun ball catching cap is able to be used in a capacity of a pseudo 'glove' and/or in the capacity of a baseball hat.

20 Claims, 5 Drawing Sheets

HOMERUN BALL CATCHING CAP SYSTEMS

CROSS-REFERENCE TO RELATED APPLICATION

The present application is related to and claims priority from prior provisional application Ser. No. 61/917,401, filed Dec. 18, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of ball hats and more specifically relates to a homerun ball catching cap for use by game fans attending baseball games.

DESCRIPTION OF THE RELATED ART

A hat is a head covering. It can be worn for protection against the elements, for ceremonial or religious reasons, for safety, or as a fashion accessory. There are many types of hats. A baseball cap is a type of soft cap with a rounded crown and a stiff peak projecting in front. The front of the cap typically contains designs or logos of sports teams, namely baseball teams, or names of relevant companies, when used as a commercial marketing technique. The back of the cap may be "fitted" to the wearer's head size or it may have a plastic, VELCRO®, or elastic adjuster so that it can be quickly adjusted to fit different wearers. The baseball cap is a part of the traditional baseball uniform worn by players, with the brim pointing forward to shield the eyes from the sun. The cap is often seen in everyday casual wear. Most caps are not multi-functional in design.

Baseball is traditionally a bat-and-ball game played between two teams of nine players who take turns batting and fielding. The offense attempts to score more runs than its opponents by hitting a ball thrown by the pitcher with a bat and moving counter-clockwise around a series of four bases: first, second, third and home plate. A run is scored when the runner advances around the bases and returns to home plate.

Players on the batting team take turns hitting against the pitcher of the fielding team, which tries to prevent runs by getting hitters out in any of several ways. A player on the batting team can stop at any of the bases and later advance on a teammate's hit or other means. The teams switch between batting and fielding whenever the fielding team records three outs. One turn at bat for both teams, beginning with the visiting team, constitutes an inning, and nine innings a game. The team with the most runs at the end of the game wins.

The object of the batter is to hit a homerun by clearing the wall at the end of the ball field. Often times there are fans seated in the stands beyond the wall where the ball is hit over. Further, foul balls may be hit into the crowd. The ball may pose a danger to fans who may be distracted. Fans normally don't wear ball gloves to the game for catching balls since it isn't convenient. An effective ball catching means that may be conveniently worn is desirable.

Various attempts have been made to solve the above-mentioned problems such as those found in U.S. Pat. Nos. 6,158,054, 5,920,913, 5,907,871, 7,600,270, 5,542,129, 4,628,543, and 4,829,600. This art is representative of hats and ball catching means. None of the above inventions and patents, taken either singly or in combination, is seen to describe the invention as claimed.

Ideally, a homerun ball catching cap (hat) should provide an effective and esthetic means to safely catch homerun (and foul) balls hit out of the playing field and, yet would operate reliably and be manufactured at a modest expense. Thus, a need exists for a reliable homerun ball catching cap to avoid the above-mentioned problems.

BRIEF SUMMARY OF THE INVENTION

In view of the foregoing disadvantages inherent in the known cap, hat and glove art, the present invention provides a novel homerun ball catching cap (Katch-O-Kapp™). The general purpose of the present invention, which will be described subsequently in greater detail is to provide an efficient and effective means to catch homerun balls that may be conveniently worn.

A homerun ball catching cap is disclosed herein, in a preferred embodiment, comprising: a cap assembly having a concave crown (having a forward edge, a rearward edge, an inner volume, and an outer surface that provides a surface on which to mount a team-logo or other such decorative means such as Katch-o-Kapp™), a headband with an adjustment strap, a bill, and circular finger apertures, wherein the cap assembly comprises in functional combination the concave crown, the headband, the bill, and the circular finger apertures.

The concave crown is of appropriate size to fit on a head of a cap-wearer; wherein the forward edge and the rearward edge are locationally opposed to each other. The inner volume, and the outer surface define parameters of the concave crown. The headband is formed and is adjustable to fit about a periphery of a head of the cap-wearer. The bill is attached to the forward edge of the concave crown and extends horizontally outwardly therefrom, the bill is also attached to the headband; the bill for partially blocking downwardly approaching sunlight from eyes of the cap-wearer.

The cap assembly comprises exactly three of the circular finger apertures in preferred embodiments; however more or less apertures may be used in alternate embodiments. In preferred embodiments the exactly three circular finger apertures comprise a left-finger-aperture, a right-finger-aperture, and a center-finger-aperture; wherein the left-finger-aperture, and the right-finger-aperture are located an equal distance from a forward end of the bill (or an uneven distance), and the center-finger-aperture is located between the left-finger-aperture, and the right-finger-aperture yet is set-back from the forward end of the bill further than the left-finger-aperture, and the right-finger-aperture. This feature provides an excellent balance-point wherein the center-finger-aperture comprises an anchor point for stabilizing the cap assembly when preparing to catch the baseball within confines of the inner volume. The center-finger-aperture is designed for insertion by a middle-finger to stabilize the anchor point. Thus three fingers may be used to hold the bill and the thumb and pinky may be used on the edges of the brim to further steady the cap assembly to absorb the force as the baseball contacts the concave crown.

The circular finger apertures provide through-holes extending through the bill; wherein the left-finger-aperture, the right-finger-aperture, and the center-finger-aperture are preferably formed via punching through material of the bill and removing the 'punched' material. Next the left-finger-aperture, the right-finger-aperture, and the center-finger-aperture are circumferentially supported and defined by a left-grommet, a right-grommet and a center-grommet, respectively, wherein the left-grommet, the right-grommet and the center-grommet each preferably comprise a 2-piece-grommet-assembly for ease of manufacture. When assembled the left-finger-aperture, the right-finger-aperture, and the center-finger-aperture provide gripping means to grasp and hold onto the bill when a baseball enters the inner volume of the concave crown. The apertures may be finished as eyelets through a sewing or stitching process such as buttonhole stitching around the perimeter of finger apertures in bill may be done. The inner volume of the concave crown is preferably size-adjustable via the adjustment strap so as to accommodate different sized the baseball(s) (hardballs, softballs or the like).

The circular finger apertures are of appropriate size and configuration to each accommodate a finger of the cap-wearer, the fingers able to extend therethrough for firmly (hooked) grasping and stabilizing the bill thus enabling the cap assembly to be used in a capacity of a glove (when removed from the head of the cap-wearer), with the concave crown serving to provide a sufficient capacity to catch the baseball within confines of the inner volume, and wherein the cap assembly further provides protection from environmental elements and esthetic appeal when worn on the head of the cap-wearer. The present invention is multi-purpose in design, efficient and cost-effective to manufacture.

A kit is described herein for sale including the cap assembly, and at least one the team-logo. Other sports memorabilia may also be included.

A method of using a homerun ball catching cap is also disclosed herein comprising the steps of: removing a cap assembly from a head of a cap-wearer, inserting an index finger into a right-finger-aperture, inserting a middle finger into a center-finger-aperture, inserting a ring finger into a left-finger-aperture, the index finger, the middle finger, the ring finger used to grippingly-hold a bill of the cap assembly for catching a baseball, the middle finger providing an anchor, catching the baseball within confines of an inner volume of a concave crown of the cap assembly, removing the baseball as a keep-sake, and wearing the cap assembly on the head of the cap-wearer to protect the cap-wearer from environmental elements.

The present invention holds significant improvements and serves as a homerun ball catching cap. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, homerun ball catching cap, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a ball cap and more particularly to a homerun ball catching cap as used to improve the safety, efficiency of catching homerun balls and also providing a uniquely functional and esthetic headwear item.

Figure 1:
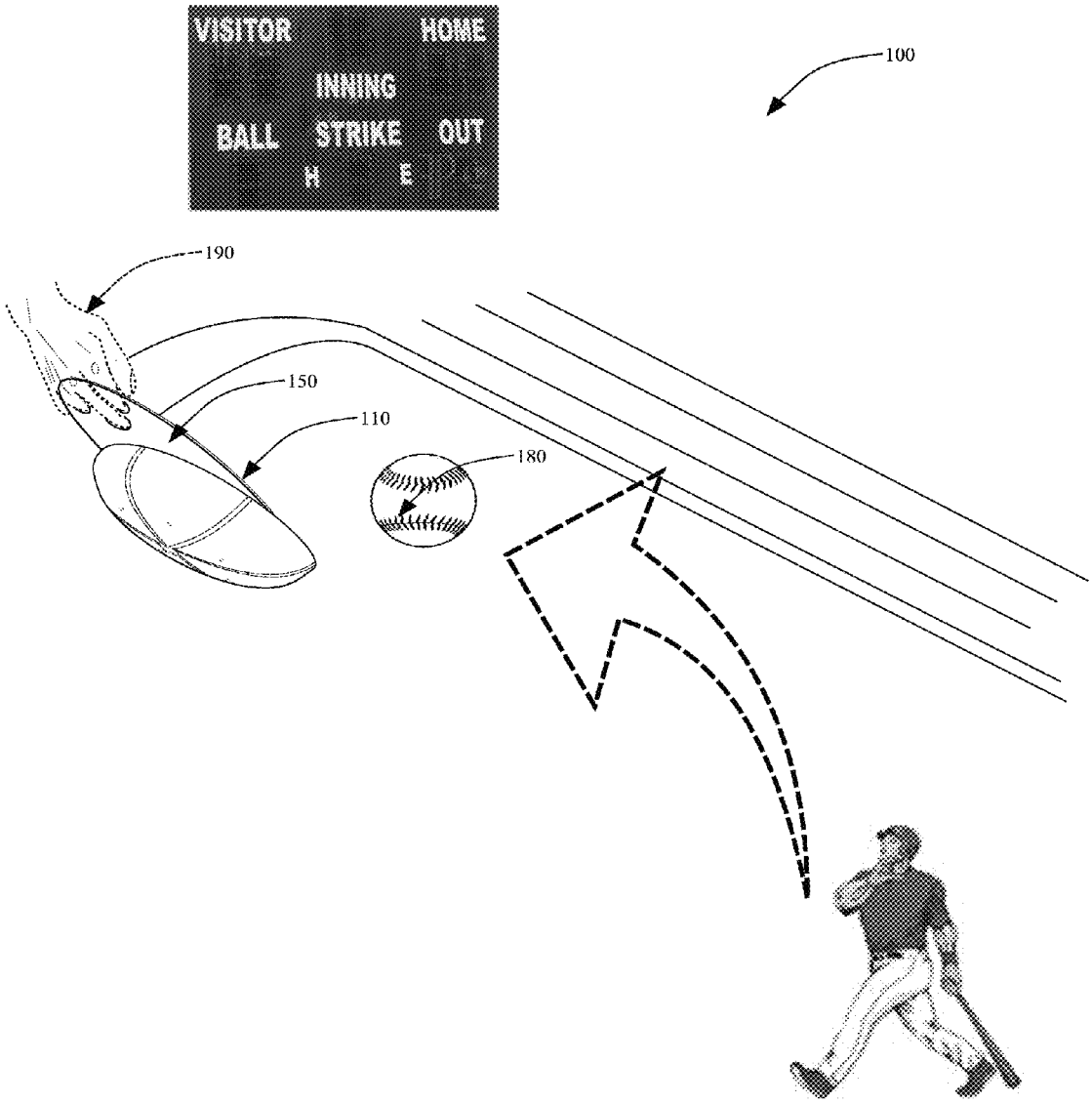
FIG. 1 shows a perspective view illustrating a homerun ball catching cap in an in-use condition according to an embodiment of the present invention.

Referring to the drawings by numerals of reference there is shown in FIG. 1, a perspective view illustrating homerun ball catching cap 110 in an in-use condition according to an embodiment of the present invention.

Homerun ball catching cap 110 comprises: cap assembly 120 having concave crown 130 (having forward edge 132, rearward edge 134, inner volume 136, and outer surface 138), headband 140, bill 150, and circular finger apertures 160; wherein cap assembly 120 comprises in functional combination concave crown 130, headband 140, bill 150, and circular finger apertures 160. Concave crown 130 is of appropriate size to fit on a head of cap-wearer 190. Forward edge 132 and rearward edge 134 are locationally opposed to each other. Inner volume 136 and outer surface 138 define parameters of concave crown 130.

Headband 140 is formed to fit about a periphery of a head of cap-wearer 190. Bill 150 is attached to forward edge 132 of concave crown 130 and extends (substantially) horizontally outwardly therefrom; bill 150 also is attached to headband 140 for structural stability. Bill 150 is useful for partially blocking downwardly approaching sunlight from the eyes of cap-wearer 190 (acting as a shade).

Circular finger apertures 160 provide through-holes 170 extending through bill 150; circular finger apertures 160 being of appropriate size and configuration to each accommodate a (matching) finger of cap-wearer 190. The fingers (of cap-wearer 190) are each able to extend therethrough and hook around front edge of the bill 150 for firmly grasping and stabilizing bill 150 thus enabling cap assembly 120 to be used in a capacity of a (pseudo) glove when removed from the head of cap-wearer 190, with concave crown 130 serving to provide a sufficient capacity to catch baseball 180 within confines of inner volume 136 during an in-use condition, and wherein cap assembly 120 further provides protection from environmental elements and esthetic appeal when worn on the head of cap-wearer 190. In this way the present invention serves multiple purposes and is comfortable in use in either capacity.

Figure 2:
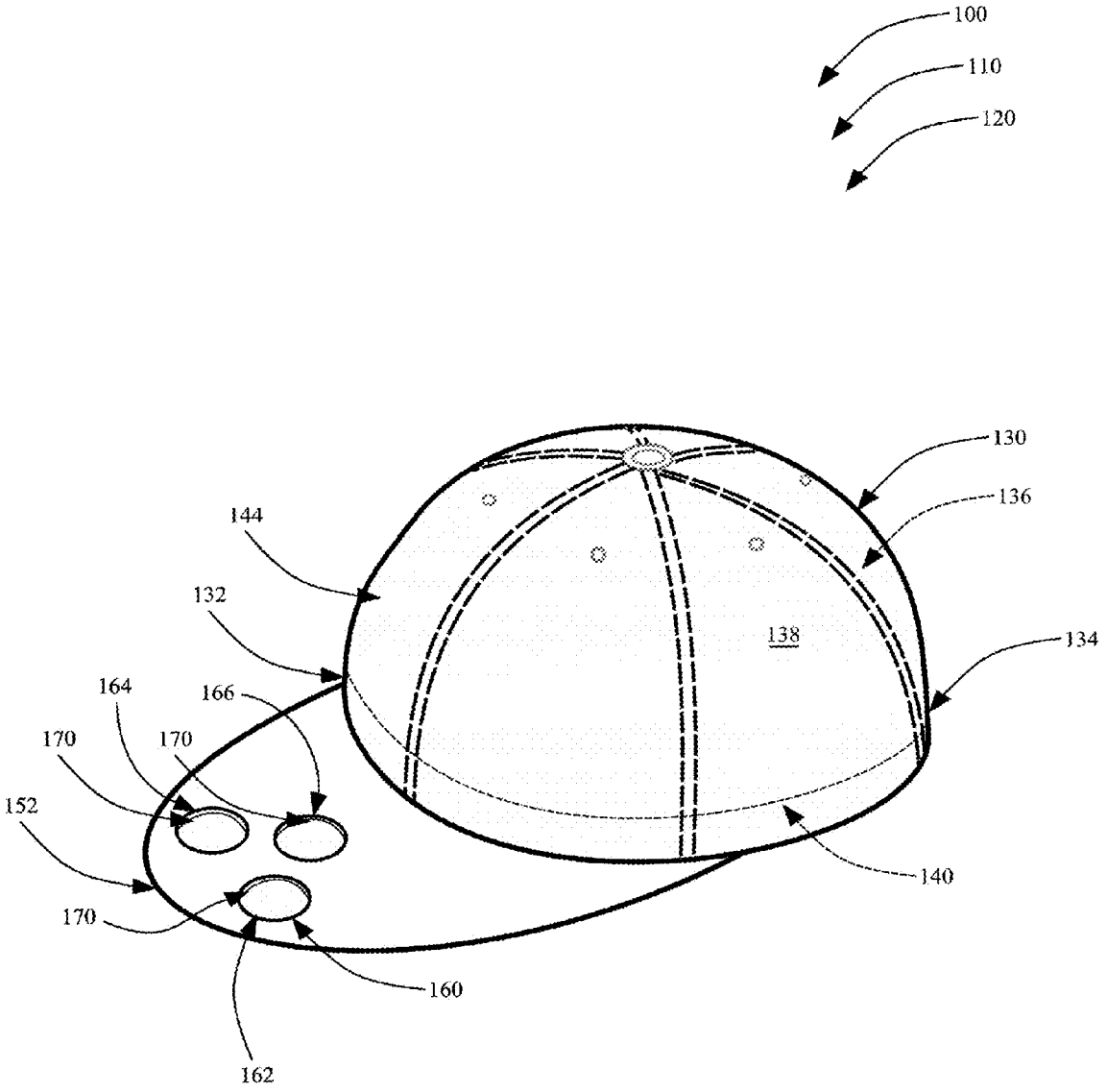
FIG. 2 is a perspective view illustrating the homerun ball catching cap according to an embodiment of the present invention of FIG. 1.

Referring now to FIG. 2, a perspective view illustrating homerun ball catching cap 110 according to an embodiment of the present invention of FIG. 1.

Cap assembly 120 in preferred embodiments comprises exactly three of circular finger apertures 160, as shown. Left-finger-aperture 162, right-finger-aperture 164, and center-finger-aperture 166 are preferably formed via punching through material of bill 150. Left-finger-aperture 162, right-finger-aperture 164, and center-finger-aperture 166 are circumferentially supported and defined by left-grommet 172, right-grommet 174 and center-grommet 176, respectively. Left-grommet 172, right-grommet 174 and center-grommet 176 may comprise plastic, metal or other suitable material, when used. Left-finger-aperture 162, right-finger-aperture 164, and center-finger-aperture 166 provide gripping means to grasp and hold onto bill 150 when baseball 180 enters inner volume 136 of concave crown 130. Left-finger-aperture 162, right-finger-aperture 164, and center-finger-aperture 166 do not comprise aperture-fillers. Concave crown 130 is adjustable via adjustment strap 142. Outer surface 138 of concave crown 130 provides surface on which to mount a team-logo 144 which may be purchased separately or in 'kit-form' as described in FIG. 4.

Figure 3:
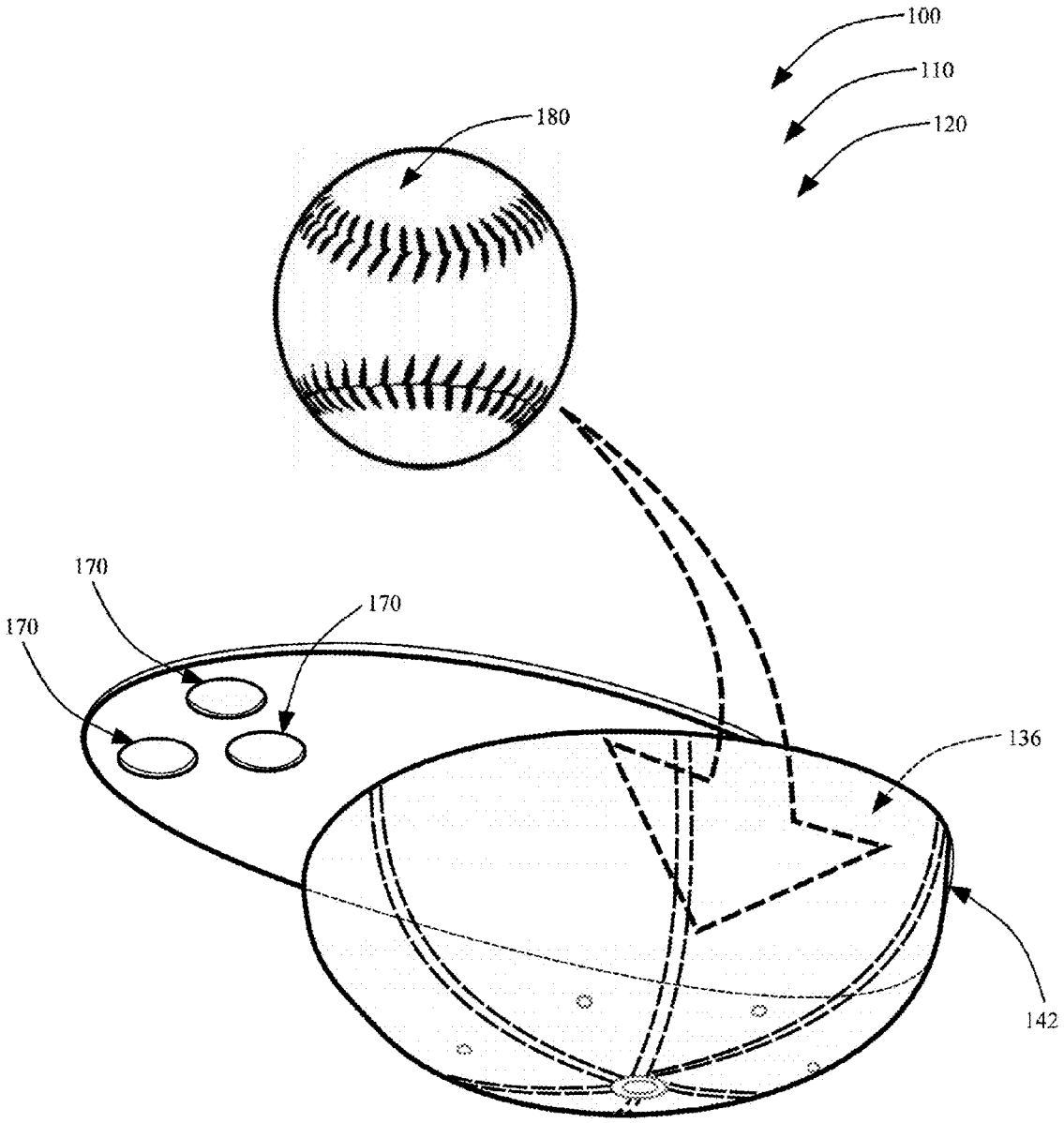
FIG. 3 is a top perspective view illustrating a bill and circular finger apertures in the homerun ball catching cap (using grommets or the like) according to an embodiment of the present invention of FIG. 1.

Referring now to FIG. 3, a top perspective view illustrating bill 150 and circular finger apertures 160 (including left-finger-aperture 162, right-finger-aperture 164, and center-finger-aperture 166) in homerun ball catching cap 110 (of homerun ball catching cap system 100) according to an embodiment of the present invention of FIG. 1.

Exactly three of the circular finger apertures 160 comprise left-finger-aperture 162, right-finger-aperture 164, and center-finger-aperture 166. Left-finger-aperture 162, and right-finger-aperture 164 are located an equal distance from forward end 152 of bill 150. Center-finger-aperture 166 is located between left-finger-aperture 162, and right-finger-aperture 164, yet is set-back from forward end 152 of bill 150 further than left-finger-aperture 162, and right-finger-aperture 164. As such, center-finger-aperture 166 is located nearer concave crown 130.

Center-finger-aperture 166 comprises an anchor point (crucial) for stabilizing cap assembly 120 when preparing to catch baseball 180 within confines of inner volume 136. Center-finger-aperture 166 is designed for insertion by a middle finger to stabilize the 'anchor point'. As previously mentioned, left-finger-aperture 162, right-finger-aperture 164, and center-finger-aperture 166 are preferably circumferentially supported and defined by left-grommet 172, right-grommet 174 and center-grommet 176, respectively. Left-grommet 172, right-grommet 174 and center-grommet 176 each preferably comprise a 2-piece-grommet-assembly for ease of manufacture. Other stitching means may be used to 'finish' out the throughholes.

Figure 4:
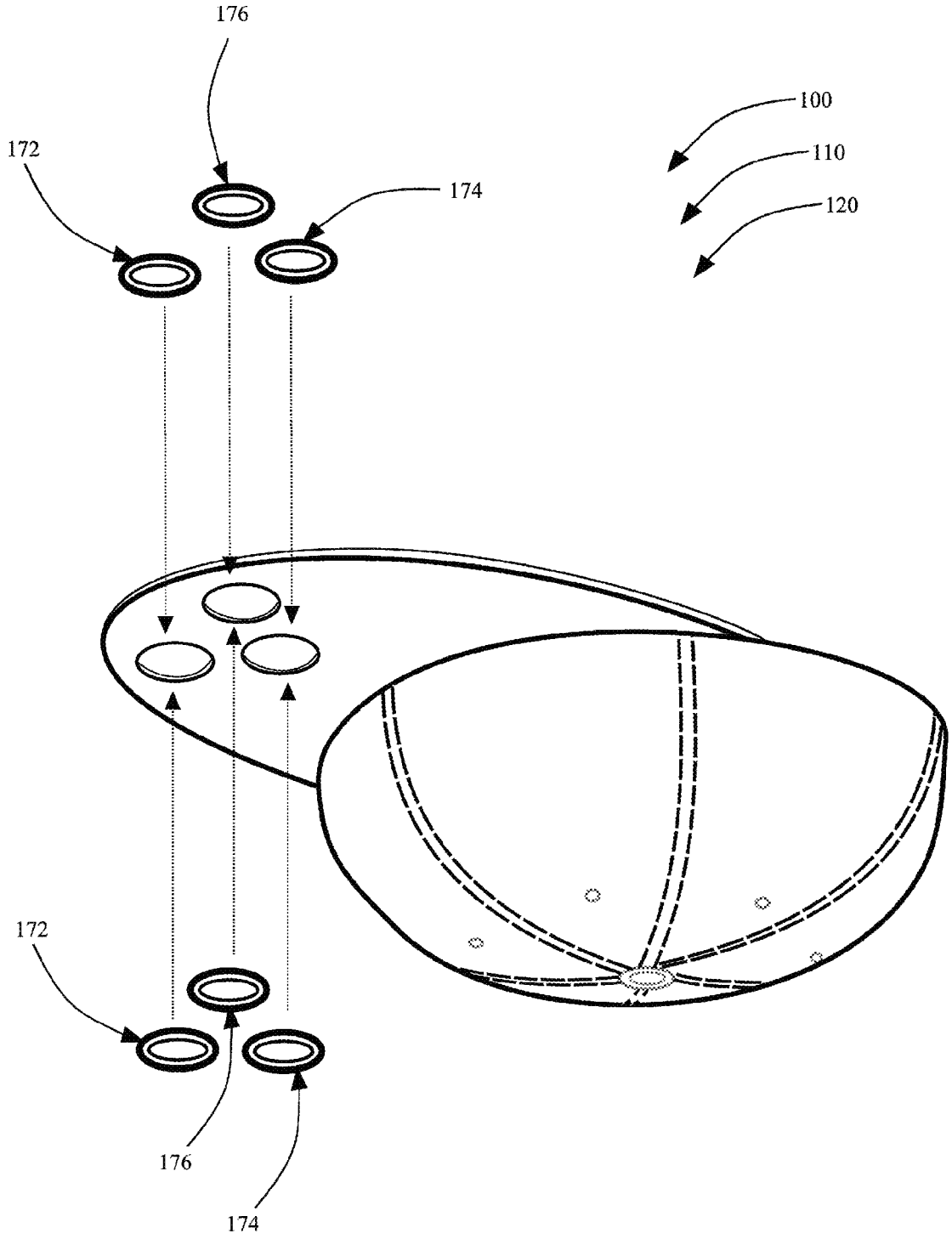
FIG. 4 is a bottom perspective view illustrating the bill and circular finger apertures in the homerun ball catching cap (using an alternate means for structurally reinforcing the apertures—flanged bushings) according to an embodiment of the present invention of FIGS. 1-3.

Referring now to FIG. 4, a bottom perspective view illustrating bill 150 and circular finger apertures 160 in homerun ball catching cap 110 according to an embodiment of the present invention of FIGS. 1-3.

In alternate embodiments left-grommet 172, right-grommet 174 and center-grommet 176 may be snapped together or in alternate embodiments each may comprise flanged bushing; wherein each of flanged bushing(s) comprising tail and head (tail and head located on opposing ends of flanged bushing as with a rivet for use). During manufacture each of tails of flanged bushings are passed through left-finger-aperture 162, right-finger-aperture 164, and center-finger-aperture 166, respectively and are 'bucked' thereafter such that they are deformed flat against bill 150 as buck-tails, each of head(s) also located adjacent and flat to bill 150, as placed. Those with ordinary skill in the art will now appreciate that upon reading this specification and by their understanding the art of apertures as described herein, methods of forming and structurally-bracing via suitable fasteners will be understood by those knowledgeable in such art.

A kit is described herein for sale including cap assembly 120, and at least one the team-logo 144. Other sports memorabilia may also be included. The kit has instructions such that functional relationships are detailed in relation to the structure of the invention (such that the invention can be used, maintained, or the like in a preferred manner). Homerun ball catching cap 110 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, different logos, different size-adjusting means, parts may be sold separately, etc., may be sufficient.

Figure 5:
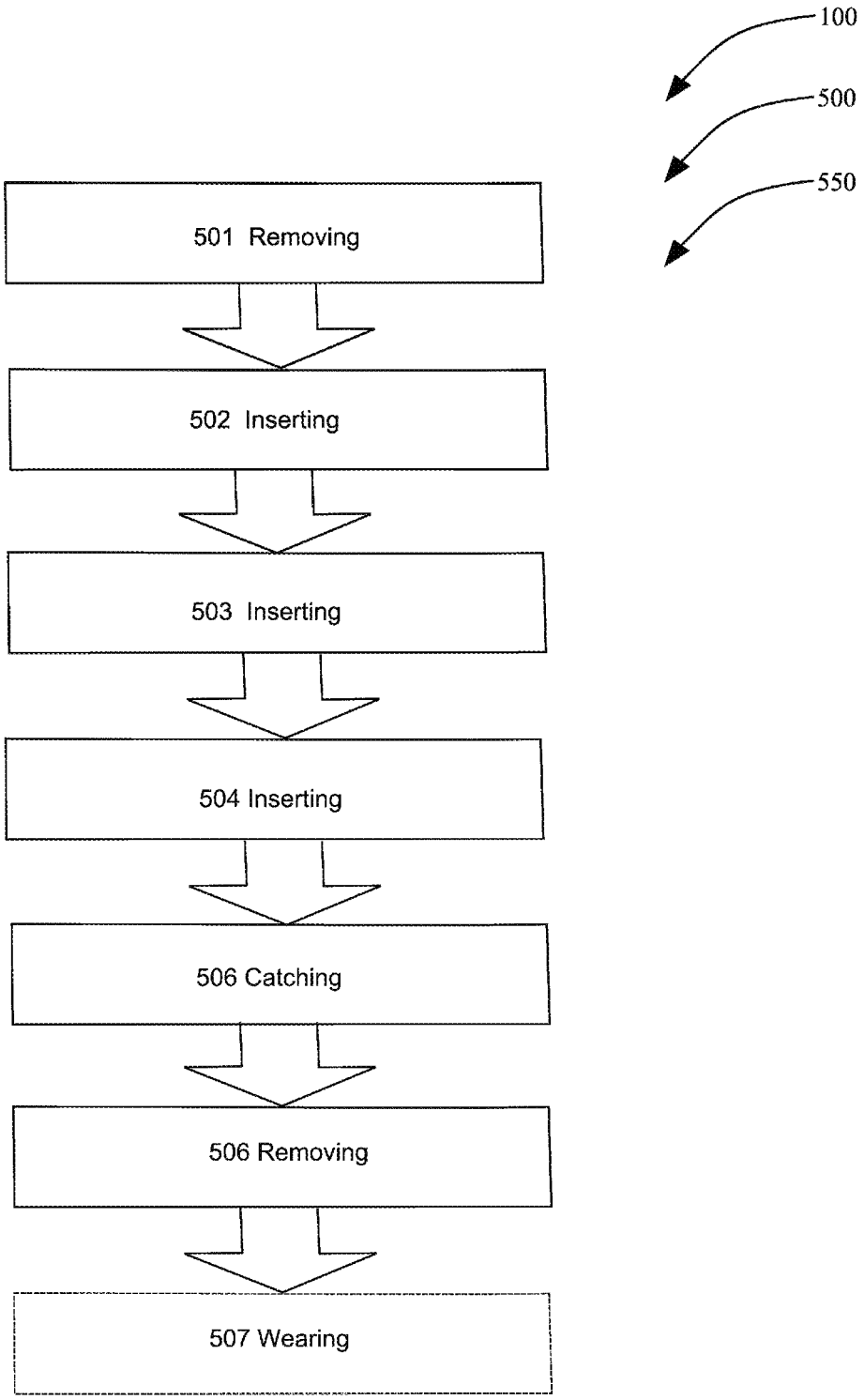
FIG. 5 is a flowchart illustrating a method of use for the homerun ball catching cap system according to an embodiment of the present invention of FIGS. 1-4.

Referring now to FIG. 5, a flowchart 550 illustrating a method of use 500 for homerun ball catching cap 110 (system 100) according to an embodiment of the present invention of FIGS. 1-4.

A method of using (method of use 500) homerun ball catching cap 110 comprises the steps of: step one 501 removing cap assembly 120 from a head of cap-wearer 190, step two 502 inserting an index finger into right-finger-aperture 164, step three 503 inserting a middle finger into center-finger-aperture 166, step four 504 inserting a ring finger into left-finger-aperture 162; the index finger, the middle finger, the ring finger are used to grippingly-hold bill 150 of cap assembly 120 for catching baseball 180, the middle finger providing an anchor, step five 505 catching baseball 180 within confines of inner volume 136 of concave crown 130 of cap assembly 120, step six 506 removing baseball 180 as a keep-sake, and step seven 507 wearing cap assembly 120 on the head of cap-wearer 190 to protect cap-wearer 190 from environmental elements (such as sunshine, rain, snow, wind and the like).

It should be noted that step 507 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A ball catching cap comprising:

a cap assembly having a concave crown with a forward edge, a rearward edge, an inner volume, an outer surface, a headband about a crown bottom edge and a bill extending outwardly and horizontally from and attached to said crown forward edge; said bill having finger apertures configured for the placement of a wearer's fingers therein;

said concave crown is configured to fit on a head of a cap wearer so that said forward edge and said rearward edge is locationally opposed to each other;

said inner volume and said outer surface define parameters of said concave crown;

and said headband is configured and formed to fit about a periphery of a head of said cap wearer;

said bill is also attached to said headband and said crown frontal portion and extends outwardly therefrom whereby said bill partially functions to block downwardly approaching sunlight form a cap wearer's eyes;

said circular finger apertures are configured to provide through holes extending through said bill and are of an appropriate size to accommodate fingers of said cap wearer; at least one of said circular finger apertures being located at a point beyond a halfway point along a length of said bill extending outwardly from said crown; said apertures being configured to allow the wearer's fingers to extend there through for firmly grasping and stabilizing said bill thus enabling the cap to be used in a capacity of a ball catching glove when removed from a wearer's head; said concave crown is configured to provide a ball catching capacity that is large enough to catch a baseball within said inner volume parameters and wherein said cap assembly further provides protection to said wearer from environmental elements as well as to provide aesthetic appeal when worn on said head of said cap wearer.

2. The ball catching cap of claim 1, wherein said cap assembly comprises exactly three of said circular finger apertures.

3. The ball catching cap of claim 2, wherein said exactly three of said circular finger apertures comprise a left-finger-aperture, a right-finger-aperture, and a centerfinger-aperture.

4. The ball catching cap of claim 3, wherein said left-finger-aperture, and said right-finger-aperture are located an equal distance from a forward end of said bill.

5. The ball catching cap of claim 4, wherein said center-finger-aperture is located between said left-finger-aperture, and said right-finger-aperture yet is set-back from said forward end of said bill further than said left-finger-aperture, and said right-fingeraperture.

6. The ball catching cap of claim 5, wherein said center-finger-aperture comprises an anchor point for stabilizing said cap assembly when preparing to catch said baseball within confines of said inner volume.

7. The ball catching cap of claim 6, wherein said center-finger-aperture is configured for insertion by a middle said finger to stabilize said anchor point.

8. The ball catching cap of claim 7, wherein said left-finger-aperture, said rightfinger-aperture, and said center-finger-aperture are formed via punching through material of said bill.

9. The ball catching cap of claim 7, wherein said left-finger-aperture, said rightfinger-aperture, and said center-finger-aperture are circumferentially supported and defined by a left-grommet, a right-grommet and a center-grommet, respectively.

10. The ball catching cap of claim 9, wherein said left-finger-aperture, said rightfinger-aperture, and said center-finger-aperture provide gripping means to grasp and hold onto said bill when said baseball enters said inner volume of said concave crown.

11. The ball catching cap of claim 10, wherein said left-finger-aperture, said rightfinger-aperture, and said center-finger-aperture do not comprise aperture-fillers.

12. The ball catching cap of claim 11, wherein said left-grommet, said rightgrommet and said center-grommet each comprise a 2-piece-grommet-assembly.

13. The ball catching cap of claim 11, wherein said left-grommet, said rightgrommet and said center-grommet each comprise a flanged bushing.

14. The ball catching cap of claim 13, wherein each of said flanged bushing(s) comprises a tail and a head.

15. The ball catching cap of claim 14, wherein each of said tails of said flanged bushings are passed through said left-finger-aperture, said right-finger-aperture, and said center-finger-aperture, respectively and are bucked thereafter such that they are deformed flat against said bill as buck-tails, each of said head(s) are also located adjacent to and flat against said bill.

16. The ball catching cap of claim 14, wherein said concave crown is adjustable via an adjustment strap.

17. The ball catching cap of claim 14, wherein said outer surface of said concave crown is configured to provide a surface on which to mount a team-logo.

18. A ball catching cap comprising:

a cap assembly having a concave crown with a forward edge; a rearward edge; an inner volume and an outer surface configured to provide a surface on which to mount a team logo;

a headband with an adjustment strap to adjust the circumferential size of the headband;

a bill extending horizontally outwardly from and attached to said forward edge of said crown and to said headband;

said bill has a circular finger apertures therein configured for the placement of a wearer's fingers therein;

said concave crown is configured to fit on a head of a cap wearer so that said forward edge and said rearward edge are locationally opposed to each other;

said inner volume and said outer surface define parameters of said concave crown and wherein said headband is configured and formed to fit about a periphery of a head of said cap wearer;

said forward edge of said concave crown extends horizontally outwardly therefrom;

said bill is also attached to said headband whereby said bill partially blocks downwardly approaching sunlight from a cap wearer's eyes;

said cap assembly comprises exactly three of said circular finger apertures that comprise a left finger aperture; a right finger aperture, and a center finger aperture;

said left finger aperture, and said right finger aperture are located an equal distance from a forward end of said bill;

said center finger aperture is located between said left finger aperture and said right finger aperture yet is set back from said forward end of said bill further than said left-finger aperture and said right finger aperture;

said center finger aperture comprises an anchor point for stabilizing said cap assembly when preparing to catch said baseball within confines of said inner volume;

said center finger aperture is configured for the insertion of a wearer's middle finger to stabilize said anchor point;

said circular finger apertures provide through holes extending though said bill;

said left finger aperture, said right finger aperture and said center finger aperture are formed via punching through material of said bill;

said left finger aperture, said right finger aperture and said center finger aperture are circumferentially supported and defined by a left, right and center grommet, respectively;

said left grommet, said right grommet and said center grommet each comprise a two piece grommet assembly;

each said left, right and center grommet aperture provide a gripping means to grasp and hold onto said bill when a ball enters said inner volume of said grommet crown;

said inner volume of said concave crown is size adjustable via said adjustment strap so as to thereby accommodate different sized baseballs;

said circular finger apertures are configured and sized to accommodate a wearer's fingers wherein said fingers are able to extend there through for firmly grasping and stabilizing said bill so that said cap assembly is used in a capacity as a glove when removed from a wearer's head and wherein said bill is configured to provide protection from environmental elements and an aesthetic appeal when worn on said head of said cap wearer.

19. The ball catching cap of claim 18 further comprising a kit including:

said cap assembly as claimed in claim 1; and at least one said team-logo on said front of said crown.

20. A method of using a ball catching cap comprising the steps of:

providing a ball catching cap as in claim 1 and removing said cap assembly from a head of a cap-wearer;

inserting an index finger into a right-finger-aperture;

inserting a middle finger into a center-finger-aperture;

inserting a ring finger into a left-finger-aperture, said index finger, said middle finger, said ring finger used to grippingly-hold a bill of said cap assembly for catching a baseball, said middle finger providing an anchor;

catching said baseball within confines of an inner volume of a concave crown of said cap assembly;

removing said baseball as a keep-sake; and wearing said cap assembly on said head of said cap-wearer to protect said capwearer from environmental elements.

* * * * *